US006943617B2

(12) United States Patent
Tran et al.

(10) Patent No.: US 6,943,617 B2
(45) Date of Patent: Sep. 13, 2005

(54) LOW VOLTAGE CMOS BANDGAP REFERENCE

(75) Inventors: Hieu Van Tran, San Jose, CA (US); Tam Huu Tran, San Jose, CA (US); Vishal Sarin, Santa Clara, CA (US); Anh Ly, San Jose, CA (US); Niang Hangzo, San Jose, CA (US); Sang Thanh Nguyen, Union City, CA (US)

(73) Assignee: Silicon Storage Technology, Inc., Sunnyvale, CA (US)

( * ) Notice: Subject to any disclaimer, the term of this patent is extended or adjusted under 35 U.S.C. 154(b) by 0 days.

(21) Appl. No.: 10/748,540

(22) Filed: Dec. 29, 2003

(65) Prior Publication Data

US 2005/0140428 A1 Jun. 30, 2005

(51) Int. Cl.[7] ..... G05F 1/10
(52) U.S. Cl. ..... 327/539
(58) Field of Search ..... 323/313, 314, 323/315, 316; 327/530, 534, 535, 539, 540

(56) References Cited

U.S. PATENT DOCUMENTS

| | | | | |
|---|---|---|---|---|
| 4,593,208 | A | 6/1986 | Single | |
| 6,150,872 | A | 11/2000 | McNeill et al. | |
| 6,507,179 | B1 * | 1/2003 | Jun et al. | 323/313 |
| 6,529,066 | B1 * | 3/2003 | Guenot et al. | 327/539 |

* cited by examiner

*Primary Examiner*—Jeffrey Zweizig
(74) *Attorney, Agent, or Firm*—DLA Piper Rudnick Gray Cary US LLP

(57) ABSTRACT

A bandgap reference generator comprises a PMOS transistor and NMOS transistor in a pnp bipolar junction transistor connected in series in a first leg. The bandgap reference generator includes a second leg that includes a PMOS transistor, an NMOS transistor, a resistor and a pnp bipolar junction transistor. A bias circuit provides a bias to a mirror formed by the gates of the PMOS transistors to lower the operating voltage of the bandgap reference generator. A second biasing circuit may provide bias to the mirror formed of the NMOS transistors. A time-based and a DC bias-based start up circuitry and method is provided.

49 Claims, 7 Drawing Sheets

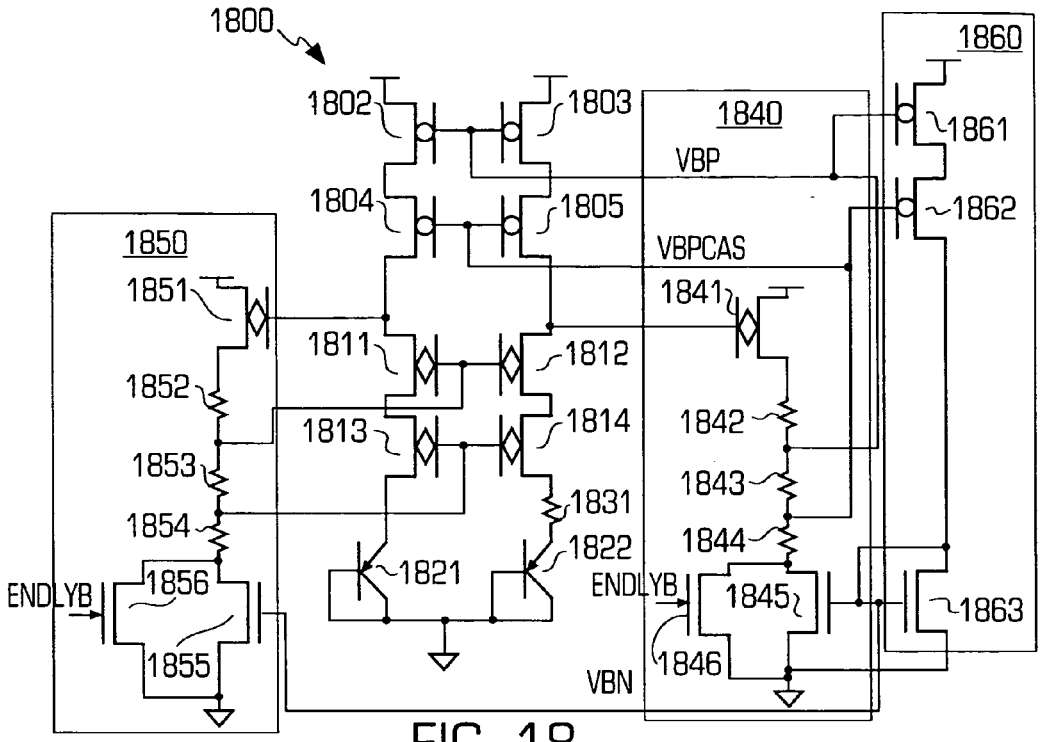
FIG. 18
FIG. 19
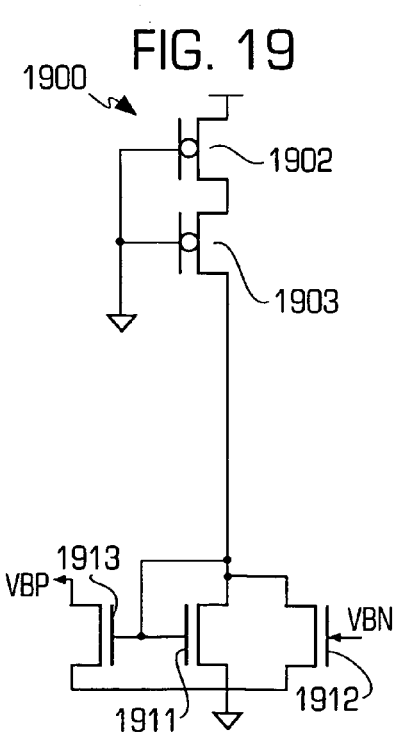
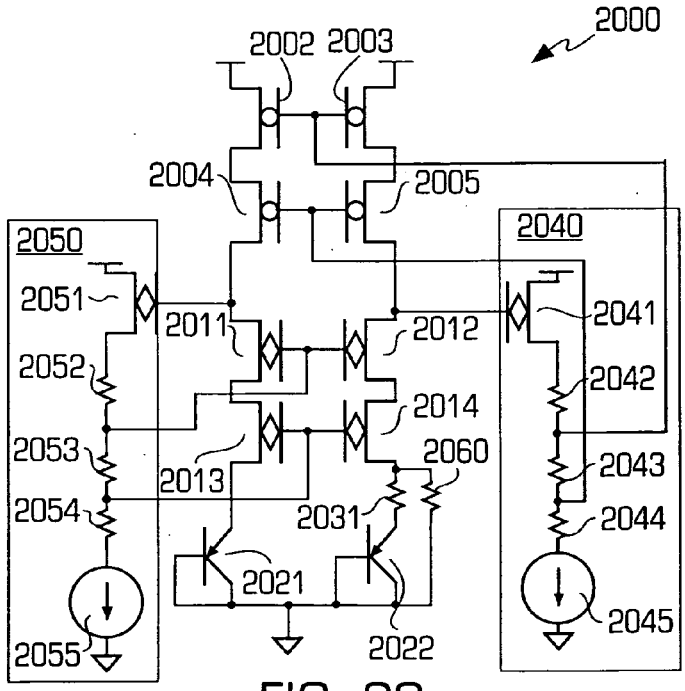
FIG. 20

LOW VOLTAGE CMOS BANDGAP REFERENCE

BACKGROUND

The invention relates to bandgap reference generators, and more particularly low voltage CMOS bandgap reference generators.

Bandgap reference generators provide constant voltages and currents over temperature ranges. However, conventional bandgap reference generators use high supply voltages, such as described below for the bandgap reference generator of FIG. 2, use higher power, such as the bandgap reference generator described below in FIG. 3, or have a slow response, such as the bandgap reference generator described below in conjunction with FIG. 4.

SUMMARY

A bandgap reference generator comprises a first circuit, a second circuit and the high impedance control circuit. The first circuit includes a first MOS transistor of a first type, a first MOS transistor of a second type, and a first bipolar junction transistor. The second circuit comprises a second MOS transistor of the first type, a second MOS transistor of the second type, a resistor, and a second bipolar junction transistor. The first and second circuits are arranged to provide a current through the resistor that is indicative of a difference in voltages across the first and second bipolar junction transistors. The MOS transistors of the first type are arranged as a mirror. The high impedance control circuit is coupled between the gate and the drain of the second MOS transistor of the first type.

In another aspect, a bandgap reference generator comprises a first circuit, a second circuit and a high impedance voltage shifter. The first circuit includes a first MOS transistor of a first type, a first MOS transistor of a second type, and a first bipolar junction transistor. The second circuit comprises a second MOS transistor of the first type, a second MOS transistor of the second type, a resistor, and a second bipolar junction transistor. The first and second circuits are arranged to provide a current through the resistor that is indicative of a difference in voltages across the first and second bipolar junction transistors. The high impedance voltage shifter is coupled between a drain and gate of said second MOS transistor of the first type.

BRIEF DESCRIPTION OF DRAWINGS

FIG. 18 is a schematic diagram illustrating a twelfth embodiment of the bandgap reference generator of the system of FIG. 1.

FIG. 19 is a schematic diagram illustrating a startup circuit of the bandgap reference generator of the system of FIG. 1.

FIG. 20 is a schematic diagram illustrating a thirteenth embodiment of the bandgap reference generator of the system of FIG. 1.

DETAILED DESCRIPTION

As used herein, a native NMOS transistor is a native low voltage transistor having a gate threshold approximately in the range of −0.1 to 0.3 volts.

As used herein, the symbol $VBE_x$ is the voltage across the base-emitter of a transistor x, and a resistance $R_y$ is the resistance of a resistor y.

Figure 1:
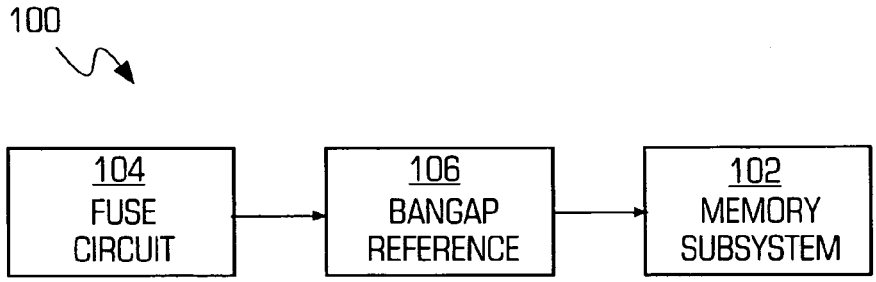
FIG. 1 is a block diagram illustrating a non-volatile digital multilevel memory system.

FIG. 1 is a block diagram illustrating a non-volatile digital multilevel memory system 100.

The non-volatile digital multilevel memory system 100 comprises a memory subsystem 102, a fuse circuit 104, and a bandgap reference generator 106.

The memory subsystem 102 comprises a plurality of memory cells (not shown), a plurality of sense amplifiers (not shown), and a plurality of decoders (not shown). The memory subsystem 102 also comprises voltage regulators and voltage supplies (not shown) for providing voltages appropriate for programming, reading, erasing and verifying the memory cells. The memory cells may include data cells and reference cells. The memory cell may store multilevel digital data. In one embodiment, the memory cells are arranged in 16K rows by 8K columns. In one embodiment, the memory array includes a source side injection flash technology, which uses lower power in hot electron programming and efficient injector based Fowler-Nordheim tunneling erasure. The programming is done by applying a high voltage on the source of the memory cell, a bias voltage on the control gate of the memory cell, and a bias current on the drain of the memory cell. The erase is done by applying a high voltage on the control gate of the memory cell and a low voltage on the source and/or drain of the memory cell. The verify (sensing or reading) is done by placing the memory cell in a voltage mode sensing, e.g., a bias voltage on the source, a bias voltage on the gate, a bias current (or zero current) on the drain, and the voltage on the drain is the readout voltage. In another embodiment, the verify (sensing or reading) is done by placing the memory cell in a current mode sensing, e.g., a low voltage on the source, a bias voltage on the gate, a load (resistive or transistors) coupled to the drain, and the voltage on the load is the readout voltage. In one embodiment, the array architecture is the one disclosed in U.S. Pat. No. 6,282,145, entitled "Array Architecture and Operating Methods for Digital Multilevel Non-volatile Memory Integrated Circuit System" by Tran et al., the subject matter of which is incorporated herein by reference.

The fuse circuit 104 stores digital data that are used to set voltages and control signals. The fuse circuit 104 includes control logic (not shown) that decodes the stored digital data to set the control signals. The fuse circuit 104 may set an output high voltage level at power up or at the start of an operation, such as program, erase or read. The output high voltage level may be different for program, erase, or read. The fuse may be, for example, a volatile memory (SRAM) based or a non-volatile memory (flash memory) based circuit.

The bandgap generator 106 provides precise voltage and current level signals over process, temperature, and supply as desired for multilevel programming, erasing, and sensing. The bandgap generator 106 may be, for example, the bandgap reference generators of FIGS. 5–12, 15–18, and 20–21.

Bandgap reference generators are next described. First, three conventional bandgap reference generators are described.

Figure 2:
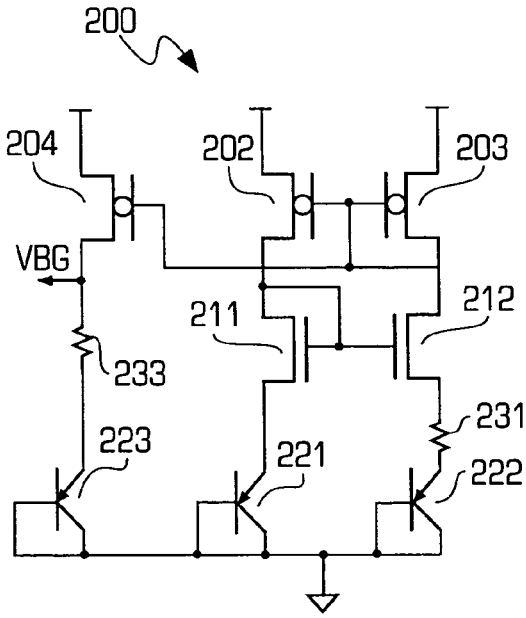
FIG. 2 PRIOR ART
FIG. 2 is a schematic diagram illustrating a conventional bandgap reference generator.

FIG. 2 is a schematic diagram illustrating a conventional band gap reference generator 200.

The band gap reference generator 200 comprises a plurality of PMOS transistors 202 through 204, a plurality of NMOS transistors 211 and 212, a plurality of pnp bipolar junction transistors 221 through 223, and a plurality of resistors 231 and 233.

The drain-source terminals of the transistors 202 and 211 and the emitter-collector junction of the PNP bipolar junction transistor 221 are coupled in series between a supply voltage (VDD) and ground. The drain-source terminals of the transistors 203 and 212, the resistor 231 and the emitter-collector terminals of the transistor 222 are coupled in series between the supply voltage (VDD) and ground. The PMOS transistor 202 and the diode connected PMOS transistor 203 are coupled to form a mirror. The gates of the diode connected NMOS transistor 211 and the NMOS transistor 212 are coupled to form a mirror. The PMOS transistor 204, the resistor 233 and the pnp bipolar junction transistor 223 are arranged in series, with the drain of the PMOS transistor 204 forming an output terminal that provides an output bandgap voltage VBG.

The current $I_{231}$ in the resistor 231 is:

$$I_{231}=(VBE_{221}-VBE_{222})/R_{231}=dVBE/R_{231}=kT/q\ ln(a)$$

where a is the emitter ratio of $VBE_{221}$ to $VBE_{222}$ and kT/q is the thermal voltage in which k is the Boltzmann constant, q is the electron charge, and T is the temperature in degrees Kelvin.

The conventional band gap reference generator 200 uses a supply voltage VDD greater than 2.0 volts. The voltage drops across the transistor 203, the transistor 212, and the series connected resistor 231 and the transistor 222 are approximately 1 volt, 0.2 volts, and 0.8 volts, respectively.

The output band gap voltage is $$VBG=VBE_{223}+(R_{233}/R_{231})dVBE\approx 1.2 \text{ volts}$$

Figure 3:
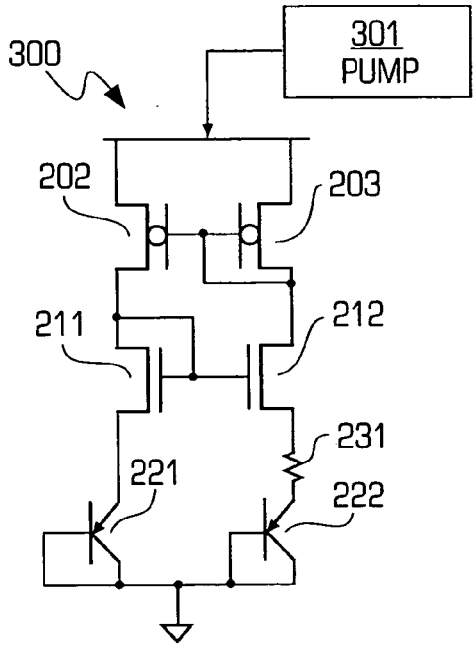
FIG. 3 PRIOR ART
FIG. 3 is a schematic diagram illustrating another conventional bandgap reference generator.

FIG. 3 is a schematic diagram of a conventional bandgap reference generator 300.

The bandgap reference generator 300 comprises a plurality of PMOS transistors 202 and 203, a plurality of NMOS transistors 211 and 211, a plurality of pnp bipolar junction transistors 221 and 222, and a resistor 231 arranged in a similar manner as the bandgap reference generator 200 described above in conjunction with FIG. 2, and further comprises a charge pump 301. The charge pump 301 provides a boosted voltage, e.g., a voltage above the minimum 2 volts. However, the bandgap reference generator 300 requires more power because of the charge pump 301.

Figure 4:
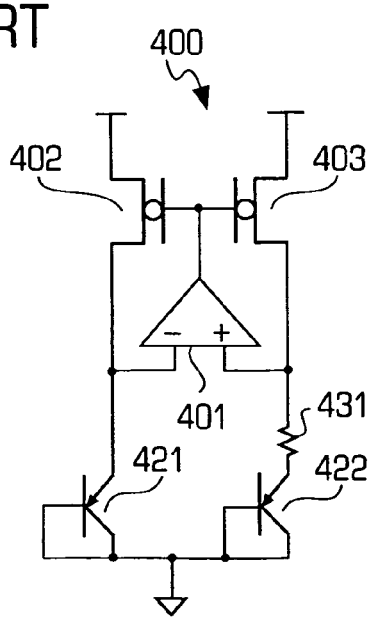
FIG. 4 PRIOR ART
FIG. 4 is a schematic diagram illustrating yet another conventional bandgap reference generator.

FIG. 4 is a schematic diagram illustrating a conventional bandgap reference generator 400.

The bandgap reference generator 400 comprises an operational amplifier 401, a plurality of PMOS transistors 402 and 403, a plurality of pnp bipolar junction transistors 421 and 422, and a resistor 431. The drain-source terminals of the PMOS transistor 402 and the emitter-collector junction of the pnp bipolar junction transistor 421 are coupled in series between a supply voltage and group. The drain-source terminals of the PMOS transistor 403, the resistor 431, and the emitter-collector terminals of the pnp bipolar junction transistor 422 are coupled in series between the supply voltage and ground. The operational amplifier 401 biases the gates of the PMOS transistors 402 and 403 in response to voltages on the drains of the PMOS transistors 402 and 403 applied to the negative and positive inputs, respectively, of the operational amplifier 401.

The conventional bandgap reference generator 400 uses a supply voltage VDD greater than 1.2 volts, but it has a slow response because of the operational amplifier 401. The voltage drops across the transistor 403, and across the combination of the resistor 431 and the pnp bipolar junction transistor 422 are approximately 0.4 volts and 0.8 volts, respectively.

Bandgap reference generators in accordance with the present invention are next described. The bandgap reference generator 106 (FIG. 1) may be the bandgap reference generators described below in conjunction with FIGS. 5–12, 15–18, and 20–21.

Figure 5:
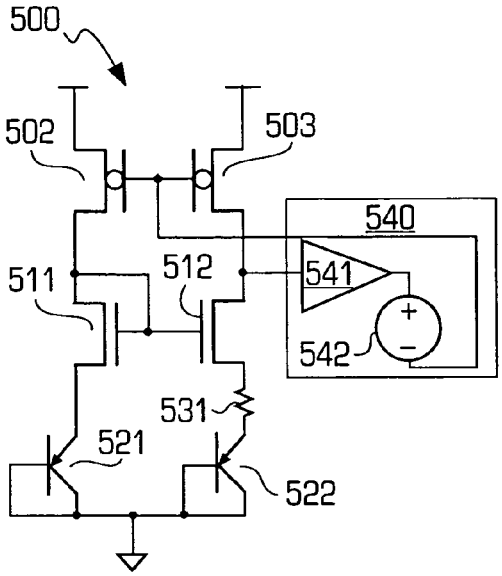
FIG. 5 is a schematic diagram of a first embodiment of a bandgap reference generator of the system of FIG. 1.

FIG. 5 is a schematic diagram of a band gap reference generator 500.

The band gap reference generator 500 comprises a plurality of PMOS transistors 502 and 503, a plurality of NMOS transistors 511 and 512, a plurality of pnp bipolar junction transistors 521 and 522, a resistor 531, and a bias control circuit 540.

The drain-source terminals of the transistors 502 and 511 and the emitter-collector terminals of the pnp bipolar junction transistor 521 are coupled in series between a voltage node and ground. The drain-source terminals of the transistors 503 and 512, the resistor 531, and the emitter-collector terminals of the pnp bipolar junction transistor 522 are coupled in series between the voltage node and ground. The gate of the PMOS transistor 503 is coupled to the gate of the PMOS transistor 502 to form a current mirror, and is coupled to the output of the bias control circuit 540. The drain of the PMOS transistor 503 is coupled to an input of the bias control circuit 540. The gate of the NMOS transistor 512 is coupled to the gate of the diode connected NMOS transistor 511 to form a current mirror. (In alternative embodiments, the bandgap reference generator 500 does not include either the NMOS current mirror or the PMOS current mirror.) The drain of the PMOS transistor 503 is coupled to the bias control circuit 540 which shifts the output to bias the gates of the PMOS transistors 502 and 503. The bias control circuit 540 allows the bandgap reference generator 500 to operate at low voltage with a fast response.

The bias control circuit 540 comprises a buffer 541 coupled in series with a voltage level shifter 542 between the input and the output of the bias control circuit 540. The buffer 541 provides a high impedance input from the drain of the PMOS transistor 503. The drain of the PMOS transistor 503 is decoupled from the gate of the transistor 503 to avoid a diode connection, and the bias control circuit 540 provides the biasing for the mirror formed by the PMOS transistors 502 and 503. The circuit path from ground through the bipolar junction transistor 522, the mirror NMOS transistor 512 and the PMOS transistor 503 is not at a voltage threshold VT connection. Hence the minimum supply voltage VDD is improved by approximately the threshold voltage VT. As an illustrative example, the voltage drops across the transistor 503, the transistor 512 and the combination of the resistor 531 and the transistor 522 are 0.4 volts, 0.2 volts, and 0.8 volts, respectively. In this illustrative example, the operating supply voltage is less than 1.4 volts.

Figure 6:
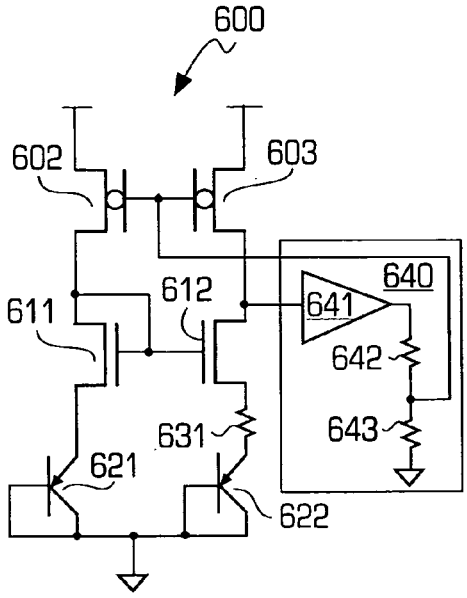
FIG. 6 is a schematic diagram of a second embodiment of the bandgap reference generator of the system of FIG. 1.

FIG. 6 is a schematic diagram illustrating a bandgap reference generator 600.

The bandgap reference generator 600 comprises a plurality of PMOS transistors 602 and 603, a plurality of NMOS transistors 611 and 612, a plurality of pnp bipolar junction transistors 621 and 622, and a resistor 631 that are arranged in a similar manner as the PMOS transistors 502 and 503, the NMOS transistors 511 and 512, the pnp bipolar junction transistors 521 and 522, and the resistor 531, respectively, of the bandgap reference generator 500 (FIG. 5). The bandgap reference generator 600 further comprises a bias control circuit 640 that is coupled to the PMOS transistor 603 in a manner similar to the bias control circuit 540 coupled to the PMOS transistor 503. The bias control circuit 640 comprises a buffer 641 and a plurality of resistors 642 and 643.

The buffer 641 provides a high impedance input from the drain of the PMOS transistor 603. The resistors 642 and 643 are coupled in series between the output of the buffer 641 and ground to provide a voltage divider between the resistors 642 and 643 for biasing the gates of the mirror formed of the PMOS transistors 602 and 603.

The bias control circuit 640 operates at low voltage with a fast response.

Figure 7:
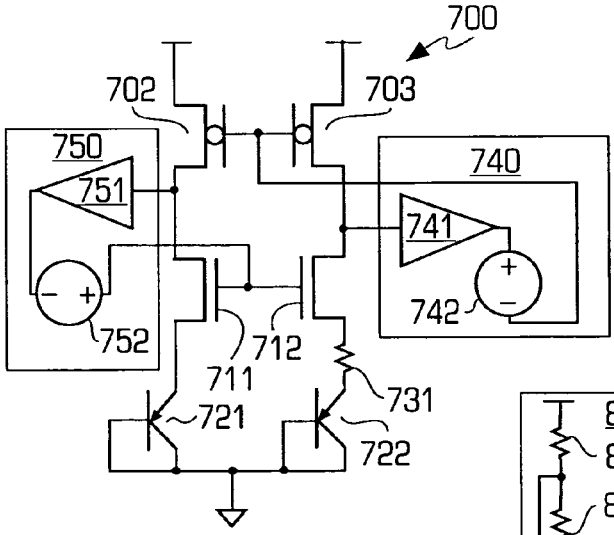
FIG. 7 is a schematic diagram of a third embodiment of the bandgap reference generator of the system of FIG. 1.

FIG. 7 is a schematic diagram illustrating a bandgap reference generator 700.

The bandgap reference generator 700 comprises a plurality of PMOS transistors 702 and 703, a plurality of NMOS transistors 711 and 712, a plurality of pnp bipolar junction transistors 721 and 722, a resistor 731, and a plurality of bias control circuits 740 and 750.

The drain-source terminals of the transistors 702 and 711 and the emitter-collector terminals of the pnp bipolar junction transistor 721 are coupled in series between a voltage node and ground. The drain-source terminals of the transistors 703 and 712, the resistor 731, and the emitter-collector terminals of the pnp bipolar junction transistor 722 are coupled in series between the voltage node and ground. The gates of the PMOS transistors 702 and 703 are coupled together to form a mirror and coupled to an output of the bias control circuit 740. The drain terminal of the PMOS transistor 703 is coupled to the input of the bias control circuit 740. The gates of the NMOS transistors 711 and 712 are coupled together to form a current mirror and are coupled to an output of the bias control circuit 750. The drain terminal of the NMOS transistor 711 is coupled to the input of the bias control circuit 750.

The bias control circuit 740 comprises a buffer 741 coupled in series with a voltage level shifter 742 between the input and the output of the bias control circuit 740. The bias control circuit 740 operates in a manner similar to the bias control circuit 540 (FIG. 5) described above.

The bias control circuit 750 comprises a buffer 751 coupled in series with a voltage level shifter 752 between the input and output of the bias control circuit 750. The drain of the NMOS transistor 711 is decoupled from the gate of the NMOS transistor 711 to avoid a diode connection. The bias control circuit 750 provides the appropriate voltage shift to reduce the voltage drop across the NMOS transistor 711.

Figure 8:
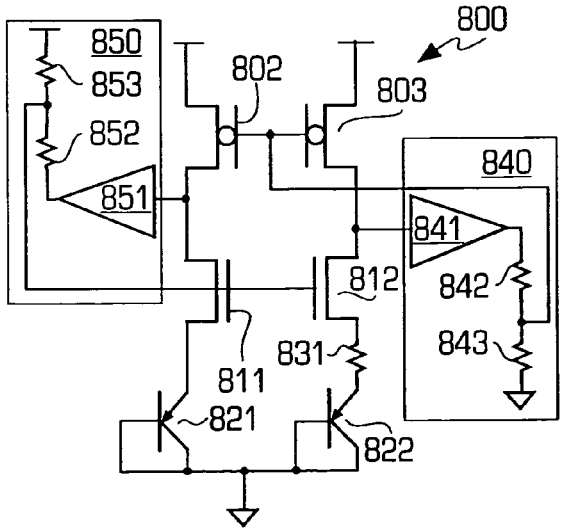
FIG. 8 is a schematic diagram of a fourth embodiment of the bandgap reference generator of the system of FIG. 1.

FIG. 8 is a schematic diagram illustrating a bandgap reference generator 800.

The bandgap reference generator 800 comprises a plurality of PMOS transistors 802 and 803, a plurality of NMOS transistors 811 and 812, a plurality of pnp bipolar junction transistors 821 and 822, and a resistor 831 that are arranged in a similar manner as the PMOS transistors 702 and 703, the NMOS transistors 711 and 712, the pnp bipolar junction transistors 721 and 722, and the resistor 731, respectively, of the bandgap reference generator 700 (FIG. 7).

The bandgap reference generator 800 further comprises a bias control circuit 840 that is coupled to the PMOS transistor 803 in a manner similar to the bias control circuit 740 coupled to the PMOS transistor 703 (FIG. 7). The bias control circuit 840 comprises a buffer 841 and a plurality of resistors 842 and 843. The buffer 841 provides a high impedance input from the drain of the PMOS transistor 803. The resistors 842 and 843 are coupled in series between the output of the buffer 841 and ground to provide a voltage divider between the resistors 842 and 843 for biasing the gates of the mirror formed of the PMOS transistors 802 and 803.

The bandgap reference generator 800 further comprises a bias control circuit 850 that is coupled to the NMOS transistor 811 in a manner similar to the control circuit 750 coupled to the NMOS transistor 711 (FIG. 7). The bias control circuit 850 comprises a buffer 851 and a plurality of resistors 852 and 853. The buffer 851 provides a high impedance input from the drain of the NMOS transistor 811. The resistors 852 and 853 are coupled in series between the output of the buffer 851 and a supply voltage to provide a voltage divider between the resistors 852 and 853 for biasing the gates of the mirror formed of the NMOS transistors 811 and 812.

Figure 9:
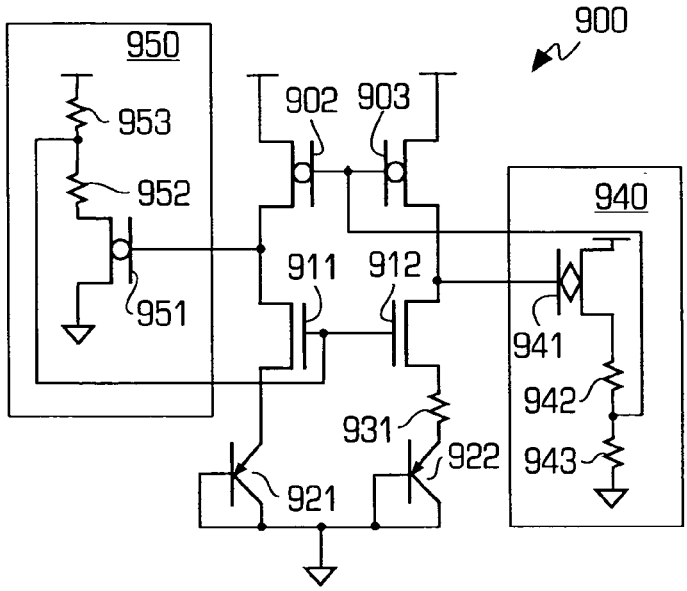
FIG. 9 is a schematic diagram of a fifth embodiment of the bandgap reference generator of the system of FIG. 1.

FIG. 9 is a schematic diagram illustrating a bandgap reference generator 900.

The bandgap reference generator 900 comprises a plurality of PMOS transistors 902 and 903, a plurality of NMOS transistors 911 and 912, a plurality of pnp bipolar transistors 921 and 922, a resistor 931, and a plurality of bias control circuits 940 and 950 that are arranged in a similar manner as the respective PMOS transistors 702 and 703, the NMOS transistors 711 and 712, the pnp bipolar junction transistors 721 and 722, the resistor 731, and the bias control circuits 740 and 750 of the bandgap reference generator 700 (FIG. 7).

The bias control circuit 940 comprises a NMOS transistor 941 and a plurality of resistors 942 and 943. The NMOS transistor 941 includes a gate coupled to the drain of the PMOS transistor 903, and the drain-source terminals coupled between the supply voltage and the resistor 942. The resistors 942 and 943 are coupled in series between the source of the NMOS transistor 941 and ground to provide a voltage divider between the resistors 942 and 943 for biasing the gates of the mirror formed of the PMOS transistors 902 and 903. In one embodiment, the NMOS transistor 941 is a native NMOS transistor.

The bias control circuit 950 comprises a PMOS transistor 951 and a plurality of resistors 952 and 953. The PMOS transistor 951 includes a gate coupled to the drain of the NMOS transistor 911, and the drain-source terminals coupled between the resistor 952 and ground. The resistors 952 and 953 are coupled in series between the supply voltage and the source of the PMOS transistor 951 to provide a voltage divider between the resistors 952 and 953 for biasing the gates of the mirror formed of the NMOS transistors 911 and 912.

The bias control circuit 950 for the mirror NMOS transistors 911 and 912 includes a PMOS transistor 951 that has a standard threshold voltage VT for PMOS, and in an illustrative embodiment the minimum supply voltage VDD is greater than 2 volts. The voltage drops across the PMOS transistor 902, across the NMOS transistor 911 and across the pnp bipolar junction transistor 921 are 1.0 volts, 0.2 volts, and 0.8 volts, respectively. In another embodiment the PMOS transistor 951 is a native PMOS transistor (e.g., threshold voltage VT ≈0.1 to −0.3 V).

Figure 10:
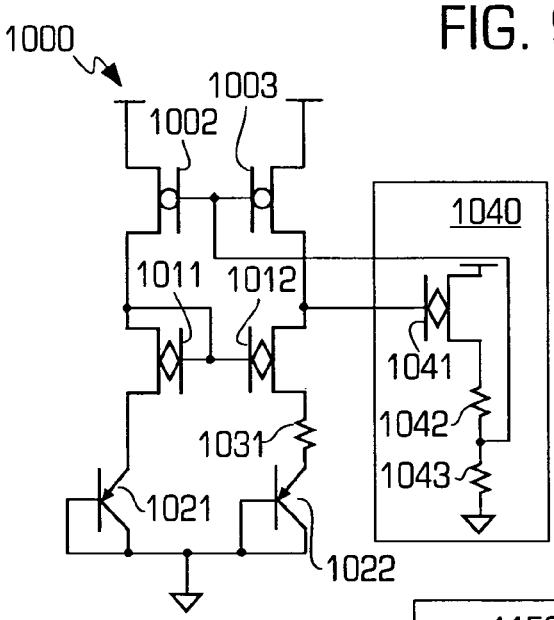
FIG. 10 is a schematic diagram of a sixth embodiment of the bandgap reference generator of the system of FIG. 1.

FIG. 10 is a schematic diagram illustrating a bandgap reference generator 1000.

The bandgap reference generator 1000 comprises a plurality of PMOS transistors 1002 and 1003, a plurality of NMOS transistors 1011 and 1012, a plurality of pnp bipolar transistors 1021 and 1022, a resistor 1031, and a bias control circuit 1040 that are arranged in a similar manner as the PMOS transistors 502 and 503, the NMOS transistors 511 and 512, the pnp bipolar junction transistors 521 and 522, the resistor 531, and the control circuit 540, respectively, of the bandgap reference generator 500 (see FIG. 5).

The bias control circuit 1040 comprises an NMOS transistor 1041 and a plurality of resistors 1042 and 1043 that are arranged in a similar manner as the NMOS transistor 941 and the resistors 942 and 943, respectively, of the control circuit 940 of the bandgap reference generator 900 (see FIG. 9).

In one embodiment, the NMOS transistors 1011, 1012, and 1041 are native NMOS transistors.

Figure 11:
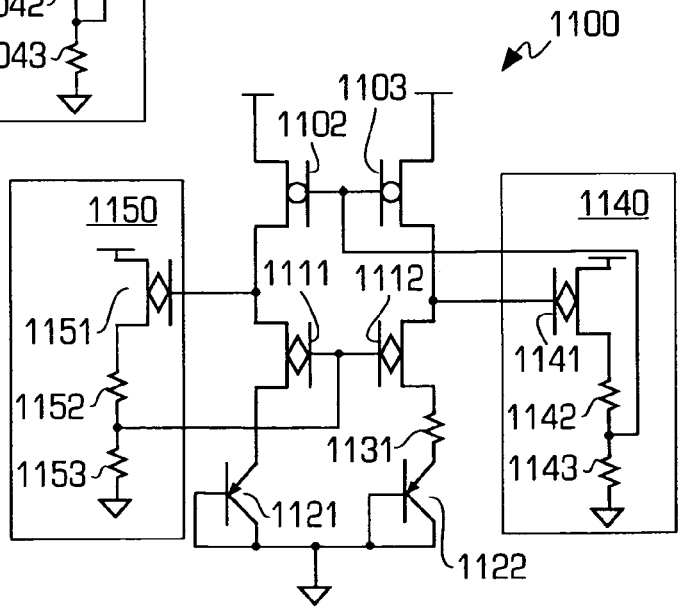
FIG. 11 is a schematic diagram of a seventh embodiment of the bandgap reference generator of the system of FIG. 1.

FIG. 11 is a schematic diagram illustrating a bandgap reference generator 1100.

The bandgap reference generator 1100 comprises a plurality of PMOS transistors 1102 and 1103, a plurality of NMOS transistors 1111 and 1112, a plurality of pnp bipolar junction transistors 1121 and 1122, a resistor 1131, and a plurality of bias control circuits 1140 and 1150 that are arranged in a similar manner as the PMOS transistor 702 and 703, the NMOS transistors 711 and 712, the pnp bipolar junction transistors 721 and 722, the resistor 731, and bias control circuits 740 and 750, respectively, of the bandgap reference generator 700 (see FIG. 7). The bias control circuit 1140 comprises an NMOS transistor 1141 and a plurality of resistors 1142 and 1143. The NMOS transistor 1141 includes a gate coupled to the drain of the PMOS transistor 1103, and includes drain-source terminals coupled between the supply voltage the resistor 1142. The resistors 1142 and 1143 are coupled in series between the source of the NMOS transistor 1141 and ground to provide a voltage divider between the resistors 1142 and 1143 for biasing the gates of the mirror formed of the PMOS transistors 1102 and 1103. The bias control circuit 1150 comprises a NMOS transistor 1151 and a plurality of resistors 1152 and 1153 that are arranged in a similar manner as the NMOS transistor 1141 and the resistors 1142 and 1143, respectively, of the bias control circuit 1140, except the gate of the NMOS transistor 1151 is coupled to the drain of the NMOS transistor 1111 and the node of the resistors 1152 and 1153 forming a voltage divider for biasing the gates of the mirror formed by the NMOS transistors 1111 and 1112. In one embodiment, the NMOS transistors 1111, 1112, 1141, and 1151 are native NMOS transistors. For a mirror formed of native NMOS transistors 1112 and 1111, the respective bias control circuit 1140 and 1150 is used to avoid a depletion condition. Thus, the voltage on the drain of the corresponding NMOS transistor 1111 or 1112 is greater than or equal to the gate voltage minus the threshold voltage ($V_g$−$V_t$) to avoid a depletion condition.

Figure 12:
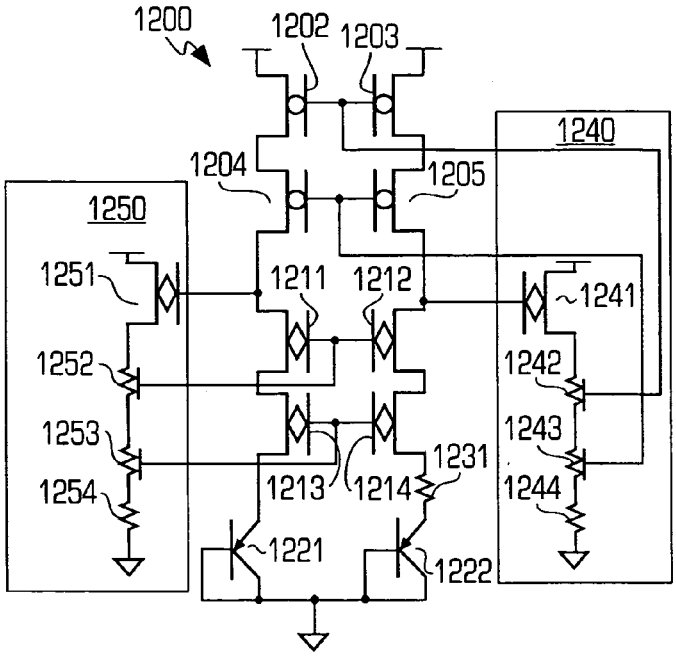
FIG. 12 is a schematic diagram of an eighth embodiment of the bandgap reference generator of the system of FIG. 1.

FIG. 12 is a schematic diagram illustrating a bandgap reference generator 1200.

The bandgap reference generator 1200 includes transistors that are arranged in cascode. The bandgap reference generator 1200 comprises a plurality of PMOS transistors 1202, 1203, 1204, and 1205, a plurality of NMOS transistors 1211, 1212, 1213, and 1214, a plurality of pnp bipolar junction transistors 1221 and 1222, a resistor 1231, and a plurality of bias control circuits 1240 and 1250. The drain-source terminals of the cascode PMOS transistors 1202 and 1204 and the cascode NMOS transistors 1211 and 1213, and the emitter-collector terminals of the bipolar junction transistor 1221 are coupled in series between the voltage node and ground. The drain-source terminals of the cascode PMOS transistors 1203 and 1205 and the cascode NMOS transistors 1212 and 1214, the resistor 1231, and the emitter-collector terminals of the pnp bipolar junction transistor 1222 are coupled in series between the voltage node and ground. The gates of the PMOS transistors 1202 and 1203 are coupled together to form a mirror. The gates of the PMOS transistors 1204 and 1205 are coupled together to form a mirror. The gates of the NMOS transistors 1211 and 1212 are coupled together to form a mirror. The gates of the NMOS transistors 1213 and 1214 are coupled together to form a mirror.

The bias control circuit 1240 comprises a NMOS transistor 1241, and a plurality of resistors 1242, 1243, and 1244. The drain of the PMOS transistor 1205 biases the gate of the NMOS transistor 1241. The resistors 1242, 1243, and 1244 are coupled in series between the source of the NMOS transistor 1241 and ground. In one embodiment, the resistors 1242 and 1243 are trimmable resistors. The variable resistance terminal of the resistors 1242 and 1243 are coupled to the gates of the mirror formed of the transistors 1202 and 1203 and the mirror formed of the transistors 1204 and 1205, respectively. In another embodiment, the resistors 1242 and 1243 are fixed resistors, and the mirrors are coupled to one of the terminals of a respective resistor. In another embodiment, the bias control circuit 1240 does not include a resistor 1244.

The bias control circuit 1250 comprises an NMOS transistor 1251, and a plurality of resistors 1252, 1253, and 1254 which are arranged in a similar manner as the NMOS transistor 1241, and the resistors 1242, 1243, and 1244, respectively, of the bias control circuit 1240, except the variable resistance terminal of the resistors 1252 and 1253 are coupled to the gates of the mirror formed by the NMOS transistors 1211 and 1212 and the mirror formed by the NMOS transistors 1213 and 1214, respectively. In one embodiment, the resistors 1252 and 1253 are trimmable resistors. In another embodiment, the resistors 1252 and 1253 are fixed resistors, and the mirrors are coupled to one of the terminals of a respective resistor 1252 and 1254. In another embodiment, the control circuit 1250 does not include a resistor 1254.

In one embodiment, the NMOS transistors 1211, 1212, 1213, 1214, 1241, and 1251 are native NMOS transistors. The bandgap reference generator 1200 may use cascoding to provide more control over the depletion conditions of the native NMOS transistors.

Figure 13:
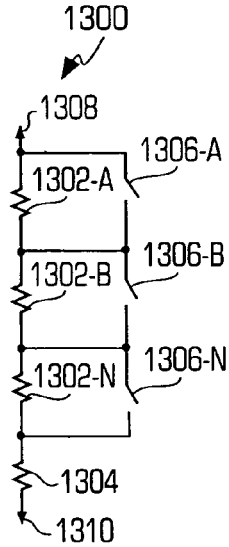
FIG. 13 is a schematic diagram illustrating a trimmable resistor of the bandgap reference generator of the system of FIG. 1.

FIG. 13 is a schematic diagram illustrating a trimmable resistor 1300.

The trimmable resistor 1300 may be used as the resistors in the embodiment of FIGS. 5–12 described above and 15–21 described below. The trimmable resistor 1300 comprises a plurality of resistors 1302-A through 1302-N, a resistor 1304, and a plurality of switches 1306-A through 1306-N. The plurality of resistors 1302-A through 1302-N and the resistor 1304 are coupled in series between a node 1308 and a node 1310. The plurality of switches 1306-A through 1306-N are coupled in parallel with a respective resistor 1302-A through 1302-N to selectively short the terminals of the respective resistor.

Figure 21:
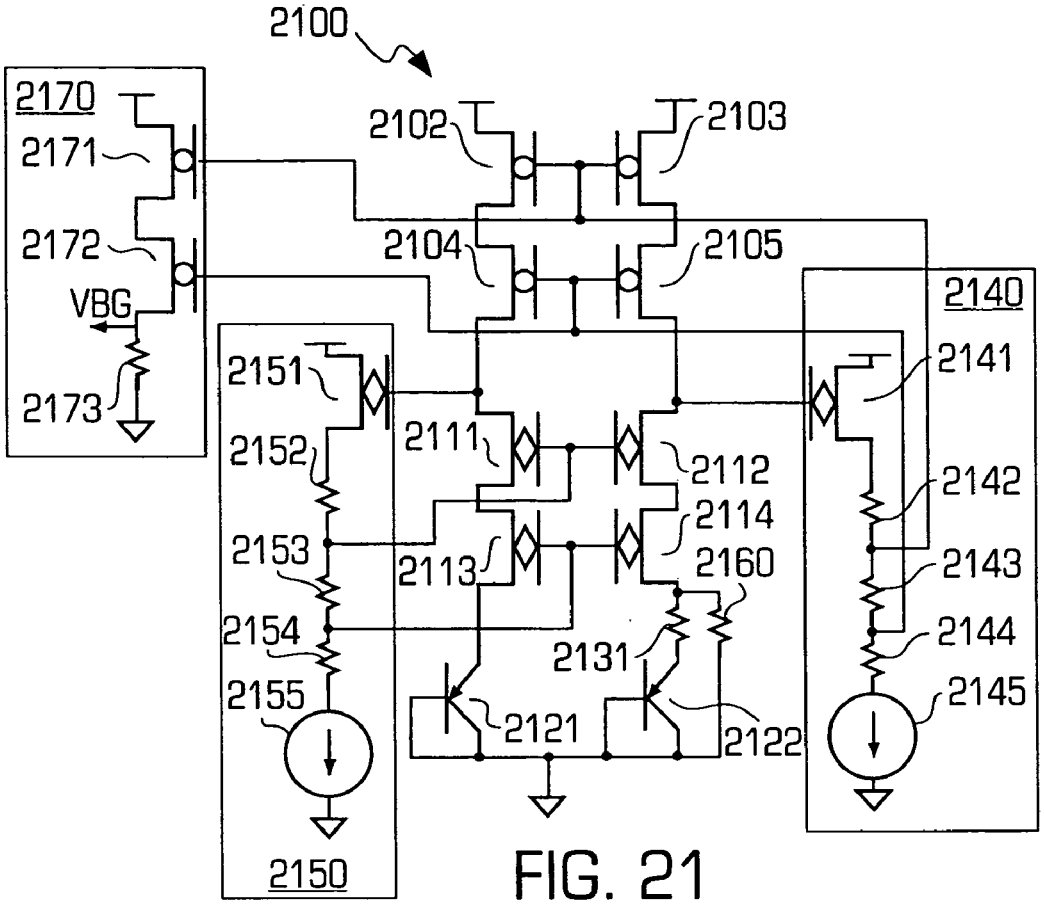
FIG. 21 is a schematic diagram illustrating a fourteenth embodiment of the bandgap reference generator of the system of FIG. 1.

The resistor 1300 is trimmable to adjust the resistance between the terminals 1308 and 1310 by opening or closing the switch 1306. The trimmable resistor 1300 may be used as the resistor 531 (FIG. 5), the resistor 631 (FIG. 6), the resistor 731 (FIG. 7), the resistor 831 (FIG. 8), the resistor 931 (FIG. 9), the resistor 1031 (FIG. 10), and the resistor 1131 (FIG. 11). The resistors 1631, 1643, 1644, 1652, 1653, and 1654 (FIG. 16), the resistors 1731, 1742, 1743, 1744, 1753, and 1754 (FIG. 17), the resistors 1831, 1842, 1843, 1844, 1852, 1853, and 1854 (FIG. 18), the resistors 2031, 2042, 2043, 2044, 2052, 2053, 2054, and 2060 (FIG. 20), and the resistors 2131, 2142, 2143, 2144, 2152, 2153, 2154, 2160, and 2173 (FIG. 21). The resistor 1300 used in the noted embodiments may be used to adjust the bias level, for example, to compensate for process corner or to output a desired value. In an alternate embodiment, the trimmable resistors in FIGS. 12 and 15 may be replaced by a trimmable resistor 1300.

In one embodiment, the switches 1306 are CMOS transistors. In another embodiment, the resistor 1300 does not include a resistor 1304.

Figure 14:
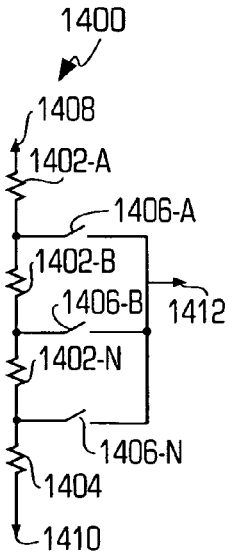
FIG. 14 is a schematic diagram illustrating a trimmable resistor of the bandgap reference generator of the system of FIG. 1.

FIG. 14 is a schematic diagram illustrating a trimmable resistor 1400.

The trimmable resistor 1400 comprises a plurality of resistors 1402-A through 1402-N, the resistor 1404, and a plurality of switches 1406-A through 1406-N. The plurality of resistors 1402-A through 1402-N and the resistor 1404 are coupled in series between a node 1408 and a node 1410 to form a plurality of voltage divider nodes formed of the common nodes of terminals of the resistors 1402. The plurality of switches 1406-A through 1406-N are coupled between a terminal of a respective resistor 1402-A through 1402-N and a node 1412 to selectively provide a divided voltage to the node 1412.

The resistor 1400 is trimmable to adjust the resistance between the terminals 1408 and 1412 and between the terminals 1410 and 1412. The trimmable resistor 1400 may be used as the resistors in the embodiments described in FIGS. 12 and 15. The resistor 1400 may be substituted for the resistor 1300. The resistor 1400 may be used to adjust the bias level, for example, to compensate for process corner or to output a desired value.

In one embodiment, the switches 1406 are CMOS transistors. In another embodiment, the resistor 1400 does not include a resistor 1404.

Figure 15:
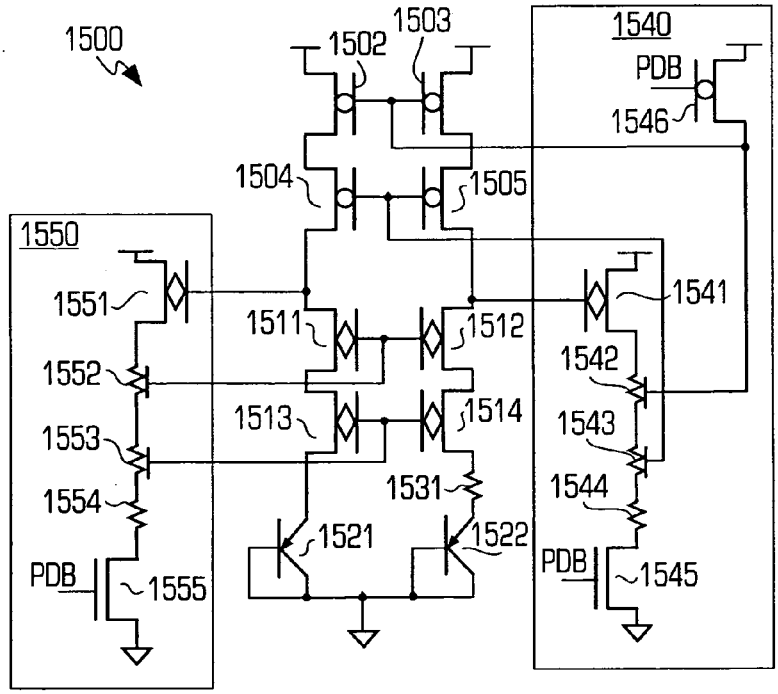
FIG. 15 is a schematic diagram illustrating a ninth embodiment of the bandgap reference generator of the system of FIG. 1.

FIG. 15 is a schematic diagram illustrating a bandgap reference generator 1500 with a power down circuit.

The bandgap reference generator 1500 comprises a plurality of PMOS transistors 1502 through 1505, a plurality of NMOS transistors 1511 through 1514, a plurality of pnp bipolar junction transistors 1521 and 1522, a resistor 1531, and a plurality of bias control circuits 1540 and 1550 that are arranged in a similar manner as the PMOS transistors 1502 through 1505, the NMOS transistors 1211 through 1214, the pnp bipolar junction transistors 1221 and 1222, the resistor 1231, and the bias control circuits 1240 and 1250, respectively, of the bandgap reference generator 1200 (FIG. 12). The bandgap reference generator 1500 includes a circuit for controlling the power down and power up of the bandgap reference generator 1500. The bias control circuit 1540 comprises an NMOS transistor 1541, and a plurality of resistors 1542 and 1544 that are arranged in a manner similar to the NMOS transistor 1241 and the resistors 1242 through 1244 of the bias control circuit 1240 (FIG. 12), except the bias control circuit 1540 further comprises an NMOS transistor 1545 and a PMOS transistor 1546. The drain-source terminals of the NMOS transistor 1545 are coupled between the resistor 1544 and ground to ground the voltage divider formed of the resistors 1542, 1543, and 1544 in response to an inverted power down signal (PDB). The drain-source terminals of the PMOS transistor 1546 couple the gates of the mirror formed of the PMOS transistors 1502 and 1503 to pull up the gates in response to the inverted power down (PDP) signal being low. The bias control circuit 1550 comprises an NMOS transistor 1551, a plurality of resistors 1552 through 1554 that are arranged in a manner similar to the NMOS transistor 1251 and the resistors 1252 through 1254 of the bias control circuit 1250 (FIG. 12), except the bias control circuit 1540 further comprises an NMOS transistor 1555. The drain-source terminals of the NMOS transistor 1555 are coupled between the resistor 1554 and ground to ground the voltage divider formed of the resistors 1552 through 1554 in response to an inverted power down signal (PDB).

Figure 16:
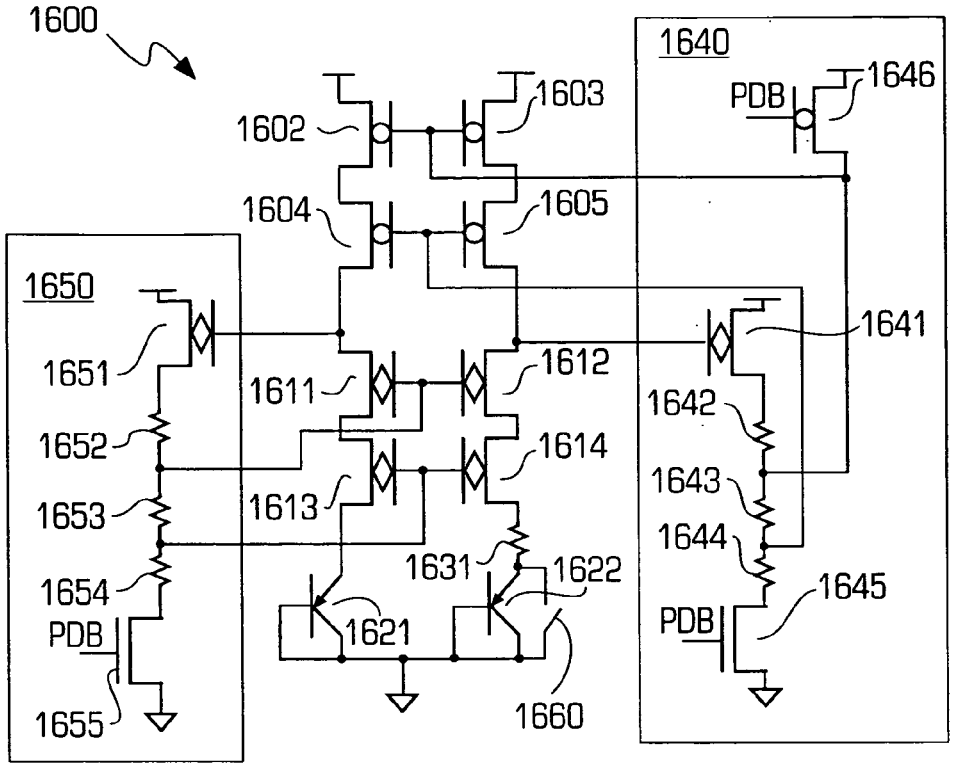
FIG. 16 is a schematic diagram of a tenth embodiment of the bandgap reference generator of the system of FIG. 1.

FIG. 16 is a schematic diagram illustrating a bandgap reference generator 1600.

The bandgap reference generator 1600 includes power down for the bias control circuits. The bandgap reference generator 1600 comprises a plurality of PMOS transistors 1602 through 1605, a plurality of NMOS transistors 1611 through 1614, a plurality of pnp bipolar junction transistors 1621 and 1622, a resistor 1631, and a plurality of bias control circuits 1640 and 1650 arranged in a similar manner as the bandgap reference generator 1300. The bias control circuit 1640 comprises a NMOS transistor 1641, a plurality of resistors 1642 through 1644, an NMOS transistor 1645, and a PMOS transistor 1646. The bias control circuit 1640 is arranged in a similar manner as the bias control circuit 1340 (FIG. 13), except the resistors 1642 and 1643 are fixed resistors and the biasing of the gates of the mirrors formed by the PMOS circuits 1602 and 1603 and the PMOS transistors 1604 and 1605 are biased by the divided voltage from the resistors 1642 and 1643. The bias control circuit 1650 comprises an NMOS transistor 1651, a plurality of resistors 1652 through 1654, and a NMOS transistor 1655 that are arranged in a similar manner as the bias control circuit 1350 (FIG. 13), except that the resistors 1652 and 1653 are not trimmable. In an alternate embodiment, the resistors 1642, 1643, 1652, and 1653 are trimmable.

The bandgap reference generator 1600 further comprises a switch 1660 coupled in parallel with the emitter-collector terminals of the pnp bipolar junction transistor 1622. The switch 1660 may be closed during power up so that the current through the resistor 1631 is:

$$I_{1631}=VBE_{1621}/R_{1631}.$$

The switch 1660 may be dynamically opened and closed to selectively short the pnp bipolar junction transistor 1622 to dynamically sample currents from the NMOS transistor 1614 as $DVBE/R_{1631}$ or $VBE_{1621}/R_{1631}$. A switch similar to the switch 1660 may be included in the bandgap reference generators of FIGS. 5–12, 15, 17–18, and 20–21.

Figure 17:
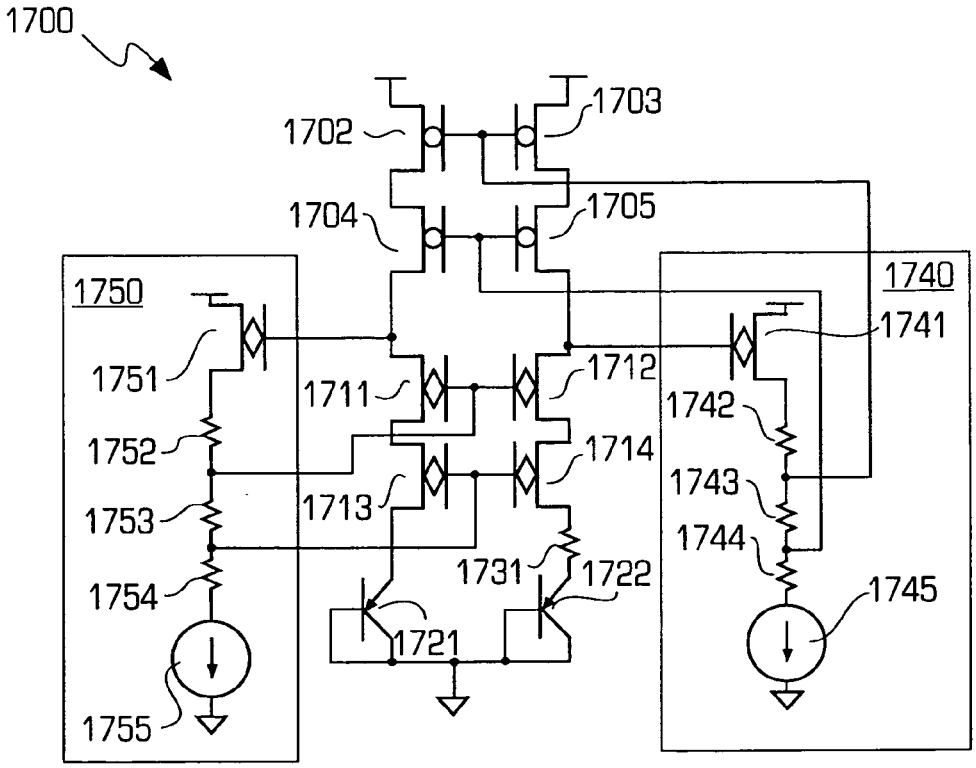
FIG. 17 is a schematic diagram illustrating an eleventh embodiment of the bandgap reference generator of the system of FIG. 1.

FIG. 17 is a schematic diagram illustrating a bandgap reference generator 1700.

The bandgap reference generator 1700 includes self bias for the bias control circuits. The bandgap reference generator 1700 comprises a plurality of PMOS transistors 1702 through 1705, a plurality of NMOS transistors 1711 through 1714, a plurality of pnp bipolar junction transistors 1721 and 1722, a resistor 1731, and a plurality of bias control circuits 1740 and 1750 arranged in a similar manner as the bandgap reference generator 1300 (FIG. 13). The bias control circuit 1740 comprises an NMOS transistor 1741, a plurality of resistors 1742 through 1744, and a current source 1745. The current source 1745 provides bias for the control circuit. The bias control circuit 1750 comprises an NMOS transistor 1751, a plurality of resistors 1752 through 1754, and a current source 1755. The current source 1755 provides bias for the control circuit 1750.

FIG. 18 is a schematic diagram illustrating a bandgap reference generator 1800.

The bandgap reference generator 1800 provides a delayed enabling of the biasing at power up to assist the startup of the bandgap reference generator 1800. The bandgap reference generator 1800 comprises a plurality of PMOS transistors 1802 through 1805, a plurality of NMOS transistors 1811 through 1814, a plurality of pnp bipolar junction transistors 1821 and 1822, a resistor 1831, and a plurality of bias control circuits 1840 and 1850 arranged in a similar manner as the respective PMOS transistors 1702 through 1705, the NMOS transistors 1711 through 1714, the pnp bipolar junction transistors 1721 and 1722, the resistor 1731, and the bias control circuit, 1740 and 1750 of the bandgap reference generator 1700 (FIG. 17). The bandgap reference generator 1800 further comprises a biasing circuit 1860 for biasing the bias control circuits 1840 and 1850.

The bias control circuit 1840 comprises an NMOS transistor 1841, a plurality of resistors 1842 through 1844, and a plurality of NMOS transistors 1845 and 1846 that are arranged in a similar manner as the respective transistor 1641, the resistors 1642 through 1644, and the transistor 1645 of the bias control circuit 1640 of the bandgap reference generator 1600 (FIG. 16), except the transistor 1845 is biased by the bias control circuit 1860. The drain-source terminals of the transistor 1846 are coupled in parallel to the drain-source terminals of the transistor 1845 to short the terminals in response to an inverted enable delay (ENDLYB signal to enable the circuit for a short delay to assist the startup of the bandgap reference generator 1800. The biasing circuit 1860 comprises a plurality of PMOS transistors 1861 and 1862 and an NMOS transistor 1863. The drain-source terminals of the PMOS transistors 1861 and 1862 and the diode connected NMOS transistor 1863 are coupled between a voltage node and ground. The resistor 1842 provides a bias voltage (VBP) to the gates of the PMOS transistors 1802, 1803 and 1861. The resistor 1843 provides a bias voltage (VBPCAS) to the cascode PMOS transistors 1804, 1805, and 1862. The drain of the NMOS transistor 1863 provides a bias voltage (VBN) to the NMOS transistor 1845 of the bias control circuit 1840.

The bias control circuit 1850 comprises an NMOS transistor 1851, a plurality of resistors 1852 through 1854, and a plurality of NMOS transistors 1855 and 1856. The NMOS transistor 1851, the resistors 1852 through 1854, and the NMOS transistor 1855 are arranged in a similar manner as the respective NMOS transistor 1651, the resistors 1652 through 1654, and the NMOS transistor 1655 of the bias control circuit 1650 of the bandgap reference generator 1600 (FIG. 16). The NMOS transistor 1855 is biased by the bias voltage (VBN) from the NMOS transistor 1863 of the biasing circuit 1861.

FIG. 19 is a schematic diagram illustrating a DC startup circuit 1900.

The DC startup circuit 1900 may be used with the bandgap reference generator 1800 of FIG. 18 to assist in the startup of the generator 1800 by providing a biasing current for the bias voltage (VBP), or the bandgap reference generators of FIGS. 5–12, 15–17, and 20–21. The DC startup circuit 1900 comprises a plurality of PMOS transistors 1902 and 1903 and a plurality of NMOS transistors 1911, 1912, and 1913. The drain-source terminals of the gate-grounded PMOS transistors 1902 and 1903 and the drain-source terminals of the diode connected NMOS transistor 1911 are coupled between a voltage node and ground. The drain-source terminals of the NMOS transistor 1912 is coupled in parallel to the drain-source terminals of the NMOS transistor 1911 and is biased by the bias voltage (VBN) from a biasing circuit, such as the biasing circuit 1800 (FIG. 18). The drain-source terminals of the NMOS transistor 1913 are coupled between the bias voltage (VBP) and ground and is biased by the drain of the PMOS transistor 1903. The NMOS transistor 1913 provides a start current ($I_{start}$) to bias the bandgap until the bias voltage (VBN) is sufficiently high to turn off the start current ($I_{start}$) by turning off the NMOS transistor 1913. The ratio of the transistors 1911, 1912, 1913 may be trimmable to adjust the bias level. In such an embodiment, the resistors may be fixed. In an embodiment in which the startup circuit 1900 is used with the bandgap reference generator 1800 (FIG. 18), the NMOS transistor 1845 provides self bias for the NMOS transistor 1841 and the resistors 1842, 1843, and 1844 using the biasing circuit 1860. The bias provided by the biasing circuit 1860 is derived from itself (the DVBE/R generator) by mirroring from the PMOS transistors 1803 and 1805. However, cross bias between the DVBE/R and VBE/R generators may be used. In this case a bias generator similar to the circuit 1860 is used for the VBE/R generator to generate a bias current to be applied to the NMOS transistor 1841 and the resistors 1842, 1843, and 1844. This current may replace the current by the NMOS transistor 1845 or in parallel with it. Similarly, this technique may be used for the bias control circuit 1850. Similarly, this cross biasing can be used for the VBE/R generator.

FIG. 20 is a schematic diagram illustrating a bandgap reference generator 2000.

The bandgap reference generator 2000 comprises a plurality of PMOS transistors 2002 through 2005, a plurality of NMOS transistors 2011 through 2014, a plurality of pnp bipolar junction transistors 2021 and 2022, a resistor 2031, a plurality of bias control circuits 2040 and 2050 arranged in a similar manner as the respective PMOS transistors 1702 through 1705, the NMOS transistors 1711 through 1714, the pnp bipolar junction transistors 1721 and 1722, the resistor 1731, and the bias control circuits 1740 and 1750 of the bandgap reference generator 1700 (FIG. 17). The bandgap reference generator 2000 further comprises a resistor 2060 coupled in parallel with a series circuit formed of the resistor 2031 and the emitter-collector terminals of the bipolar junction transistor 2022. The resistor 2060 in conjunction with the pnp bipolar junction transistor 2022 and the resistor 2031 form a zero temperature coefficient current IREF by combining a positive temperature compensated current $\{I_{R2031}=(VBE_{2021}-VBE_{2022})/R_{2031}=1/R_{2031}*kT/q\ \ln\ (a)\}$ and a negative temperature compensated current $\{I_{R2060}=VBE_{2021}/R_{2061}\}$. In one embodiment, the resistor 2060 has a non-zero temperature coefficient, and the weighted reference current IREF may be formed of the positive or negative temperature coefficient to compensate by varying the resistance of the resistor 2060.

The bias control circuit 2040 comprises an NMOS transistor 2041, a plurality of resistors 2042 through 2044, and a current source 2045 that are arranged in a similar manner as the respective transistor 1741, the resistor 1742 through 1744, and the current source 1745 of the bias control circuit 1740 of the bandgap reference generator 1700 (FIG. 17). The bias control circuit 2050 comprises an NMOS transistor 2051, a plurality of resistors 2052 through 2054, and a current source 2055 arranged in a similar manner as the NMOS transistor 1751, the resistors 1752 through 1754, and the current source 1755 of the bias control circuit 1750 of the bandgap reference generator 1700. The bias control circuits 2040 and 2050 function in a similar manner as the bias control circuits 1740 and 1750 of the bandgap reference generator 1700 (FIG. 17) described above.

FIG. 21 is a schematic diagram illustrating a bandgap reference generator 2100.

A bandgap reference generator 2100 provides a zero temperature coefficient current REF and a zero temperature coefficient voltage VBG. The bandgap reference generator 2100 comprises a plurality of PMOS transistors 2102 through 2105, a plurality of NMOS transistors 2111 through 2114, a plurality of pnp bipolar junction transistors 2121 and 2122, a resistor 2131, a plurality of bias control circuits 2140 and 2150, and a resistor 2160 arranged in a similar manner as the respective PMOS transistors 2002 through 2005, the NMOS transistors 2011 through 2014, the pnp bipolar junction transistors 2021 and 2022, the resistor 2031, the bias control circuits 2040 and 2050, and the resistor 2060 of the bandgap reference generator 2000 (FIG. 20).

The bias control circuit 2140 comprises an NMOS transistor 2141, a plurality of resistors 2142 through 2144, and a current source 2145 that are arranged in a similar manner as the respective transistor 2041, the resistors 2042 through 2044, and the current source 2045 of the bias control circuit 2040 of the bandgap reference generator 2000 (FIG. 20). The bias control circuit 2150 comprises an NMOS transistor 2151, a plurality of resistors 2152 through 2154, and the current source 2155 arranged in a similar manner as the NMOS transistor 2051, the resistors 2052 through 2054, and the current source 2055, respectively, of the bias control circuit 2050 of the bandgap reference generator 2000 (FIG. 20).

The bandgap reference generator 2100 further comprises an output circuit 2170 that comprises a plurality of PMOS transistors 2171 and 2172 and a resistor 2173. The drain-source terminals of the PMOS transistors 2171 and 2172 and the resistor 2173 are coupled in series between a voltage node and ground and generate a bandgap voltage (VBG) on the drain of the PMOS transistor 2172. The gates of the PMOS transistors 2171 and 2172 are coupled to the resistors 2142 and 2143, respectively and form a mirror with the respective PMOS transistors 2102 and 2104.

In this disclosure, there is shown and described only the preferred embodiments of the invention, but it is understood that the invention is capable of use in various other combinations and environments and is capable of changes or modifications within the scope of the inventive concept as expressed herein.

What is claimed is:

1. A bandgap reference generator comprising:

a current mirror circuit having two current paths, a first current path passing through a first MOS transistor and a first bipolar junction transistor; a second current path passing through a second MOS transistor, a resistor, and a second bipolar junction transistor, wherein a current through said resistor is indicative of a difference in voltages across the first and second bipolar junction transistors; and a high impedance control circuit including a single signal input coupled to a drain of said second MOS transistor and including an output coupled to a gate of said second MOS transistor.

2. The bandgap of claim 1 wherein the resistor is trimmable.

3. A bandgap reference generator comprising:

a current mirror circuit having two current paths, a first current path passing through a first MOS transistor and a first bipolar junction transistor; a second current path passing through a second MOS transistor, a resistor, and a second bipolar junction transistor, wherein a current through said resistor is indicative of a difference in voltages across the first and second bipolar junction transistors; and a high impedance voltage shifter including a single signal input coupled to a drain of said second MOS transistor and including an output coupled to a gate of said second MOS transistor.

4. The bandgap of claim 3 wherein the resistor is trimmable.

5. A bandgap reference generator comprising:

a first circuit including a first MOS transistor of a first type, a first MOS transistor of a second type, and a first bipolar junction transistor;

a second circuit comprising a second MOS transistor of the first type, a second MOS transistor of the second type, a resistor, and a second bipolar junction transistor, the first and second circuits being arranged to provide a current through the resistor indicative of a difference in voltages across the first and second bipolar junction transistors, the MOS transistors of the first type being arranged as a mirror; and a high impedance control circuit coupled between a drain and a gate of said second MOS transistor of the first type.

6. A system comprising:

a memory array;

a fuse circuit; and a bandgap reference generator of claim 5.

7. A bandgap reference generator comprising:

a first circuit including a first MOS transistor of a first type, a first MOS transistor of a second type, and a first bipolar junction transistor;

a second circuit comprising a second MOS transistor of the first type, a second MOS transistor of the second type, a resistor, and a second bipolar junction transistor, the first and second circuits being arranged to provide a current through the resistor indicative of a difference in voltages across the first and second bipolar junction transistors, the MOS transistors of the first type being arranged as a mirror;

a high impedance control circuit coupled between a drain and a gate of said second MOS transistor of the first type; and a sampling switch to periodically sample positive temperature and negative temperature coefficient currents in said second circuit.

8. A system comprising:

a memory array;

a fuse circuit; and a bandgap reference generator of claim 7.

9. The bandgap of claim 7 wherein the current is trimmable through the resistor.

10. A bandgap reference generator comprising:

a first circuit including a first MOS transistor of a first type, a first MOS transistor of a second type, and a first bipolar junction transistor;

a second circuit comprising a second MOS transistor of the first type, a second MOS transistor of the second type, a resistor, and a second bipolar junction transistor, the first and second circuits being arranged to provide a current through the resistor indicative of a difference in voltages across the first and second bipolar junction transistors, the MOS transistors of the first type being arranged as a mirror; and a high impedance voltage shifter coupled between a drain and a gate of said second MOS transistor of the first type.

11. A system comprising:

a memory array;

a fuse circuit; and a bandgap reference generator of claim 10.

12. The bandgap of claim 10 wherein the voltage shifter is trimmable.

13. A bandgap reference generator comprising:

a first circuit including a first MOS transistor of a first type, a first MOS transistor of a second type, and a first bipolar junction transistor;

a second circuit comprising a second MOS transistor of the first type, a second MOS transistor of the second type, a resistor, and a second bipolar junction transistor, the first and second circuits being arranged to provide a current through the resistor indicative of a difference in voltages across the first and second bipolar junction transistors, the MOS transistors of the first type being arranged as a mirror; and a high impedance voltage shifter coupled between a drain and a gate of said first MOS transistor of the second type.

14. A system comprising:

a memory array;

a fuse circuit; and a bandgap reference generator of claim 13.

15. A bandgap reference generator comprising:

a first MOS transistor of a first type including first and second terminals spaced apart with a channel therebetween and including a gate for controlling current in said channel, said first terminal being coupled to a voltage node;

a first MOS transistor of a second type including first and second terminals spaced apart with a channel therebetween and including a gate for controlling current in said channel, said first terminal being coupled to the second terminal of the first MOS transistor of the first type and to said gate;

a first bipolar junction transistor including an emitter coupled to the second terminal of the first MOS transistor of the second type, including a collector coupled to a ground node, and including a base coupled to said collector;

a second MOS transistor of the first type including first and second terminals spaced apart with a channel therebetween and including a gate for controlling current in said channel, said first terminal being coupled to said voltage node, said gate being coupled to the gate of the first MOS transistor of the first type;

a second MOS transistor of the second type including first and second terminals spaced apart with a channel therebetween and including a gate for controlling current in said channel, said first terminal being coupled to the second terminal of the second MOS transistor of the first type, said gate being coupled to the gate of the first MOS transistor of the second type;

a first resistor including first and second terminals, said first terminal being coupled to the second terminal of the second MOS transistor of the second type;

a second bipolar junction transistor including an emitter coupled to the second terminal of the first resistor, including a collector coupled to said ground node, and including a base coupled to said collector; and a control circuit including an input coupled to the second terminal of the second MOS transistor of the first type and an output coupled to the gate of the second MOS transistor of the first type.

16. A system comprising:

a memory array;

a fuse circuit; and a bandgap reference generator of claim 15.

17. The bandgap reference generator of claim 15 wherein the control circuit biases said first and second transistors of the first type.

18. The bandgap reference generator of claim 15 wherein the control circuit comprises a voltage level shifter.

19. The bandgap reference generator of claim 18 wherein the control circuit comprises a buffer coupled to the input of the control circuit and said voltage level shifter is coupled to the output of the control circuit.

20. The bandgap reference generator of claim 15 further comprising a switch coupled between the emitter and the collector of the second bipolar junction transistor to selectively short said emitter to said collector.

21. The bandgap reference generator of claim 15 wherein the control circuit comprises a buffer having an input coupled to the input of the control circuit and having an output, comprises a second resistor including a first terminal coupled to the output of the buffer and including a second terminal coupled to the output of the control circuit, and comprises a third resistor including a first terminal coupled to the second terminal of the second resistor and including a second terminal coupled to the ground node.

22. The bandgap reference generator of claim 15 wherein the control circuit comprises a third transistor of the second type including first and second terminals spaced apart with a channel therebetween and a gate for controlling current in said channel, said first terminal is coupled to another voltage node and said gate is coupled to the input of the control circuit, the control circuit further comprises a second resistor including a first terminal coupled to the second terminal of the third transistor of the second type and including a second terminal coupled to the output of the control circuit, and comprises a third resistor including a first terminal coupled to the second terminal of the second resistor and including a second terminal coupled to the ground node.

23. A bandgap reference generator comprising:

a first MOS transistor of a first type including first and second terminals spaced apart with a channel therebetween and including a gate for controlling current in said channel, said first terminal being coupled to a voltage node;

a first MOS transistor of a second type including first and second terminals spaced apart with a channel therebetween and including a gate for controlling current in said channel, said first terminal being coupled to the second terminal of the first MOS transistor of the first type;

a first bipolar junction transistor including an emitter coupled to the second terminal of the first MOS transistor of the second type, including a collector coupled to a ground node, and including a base coupled to said collector;

a second MOS transistor of the first type including first and second terminals spaced apart with a channel therebetween and including a gate for controlling current in said channel, said first terminal being coupled to said voltage node, said gate being coupled to the gate of the first MOS transistor of the first type;

a second MOS transistor of the second type including first and second terminals spaced apart with a channel therebetween and including a gate for controlling current in said channel, said first terminal being coupled to the second terminal of the second MOS transistor of the first type, said gate being coupled to the gate of the first MOS transistor of the second type;

a first resistor including first and second terminals, said first terminal being coupled to the second terminal of the second MOS transistor of the second type;

a second bipolar junction transistor including an emitter coupled to the second terminal of the first resistor, including a collector coupled to said ground node, and including a base coupled to said collector;

a first control circuit including an input coupled to the first terminal of the first MOS transistor of the second type and an output coupled to the gate of the first MOS transistor of the second type; and a second control circuit including an input coupled to the second terminal of the second MOS transistor of the first type and an output coupled to the gate of the second MOS transistor of the first type.

24. The bandgap reference generator of claim 23 wherein the first and second control circuits each comprise a voltage level shifter.

25. The bandgap reference generator of claim 24 wherein the first and second control circuits each comprise a buffer.

26. The bandgap reference generator of claim 23 further comprising a switch coupled between the emitter and the collector of the second bipolar junction transistor to selectively short said emitter to said collector.

27. The bandgap reference generator of claim 23, wherein the first control circuit comprises a first buffer having an input coupled to the input of the first control circuit and having an output, comprises a second resistor including a first terminal coupled to the output of the first buffer and including a second terminal coupled to the output of the first control circuit, and comprises a third resistor including a first terminal coupled to the second terminal of the second resistor and including a second terminal coupled to another voltage node, wherein the second control circuit comprises a second buffer having an input coupled to the input of the second control circuit and having an output, comprises a fourth resistor including a first terminal coupled to the output of the second buffer and including a second terminal coupled to the output of the second control circuit, and comprises a fifth resistor including a first terminal coupled to the second terminal of the fourth resistor and including a second terminal coupled to the ground node.

28. The bandgap reference generator of claim 23, wherein the first control circuit comprises a third transistor of the first type including first and second terminals spaced apart with a channel therebetween and including a gate for controlling current in said channel, said second terminal is coupled to the ground node and said gate is coupled to the input of the first control circuit, comprises a second resistor including a first terminal coupled to the first terminal of the third transistor of the first type and including a second terminal coupled to the output of the first control circuit, and comprises a third resistor including a first terminal coupled to the second terminal of the second resistor and including a second terminal coupled to another voltage node, the second control circuit comprises a third transistor of the second type including first and second terminals spaced apart with a channel therebetween and including a gate for controlling current in said channel, said first terminal is coupled to said another voltage node and said gate is coupled to the input of the second control circuit, comprises a fourth resistor including a first terminal coupled to the second terminal of the third transistor of the second type and including a second terminal coupled to the output of the second control circuit, and comprises a fifth resistor including a first terminal coupled to the second terminal of the fourth resistor and including a second terminal coupled to the ground node.

29. The bandgap reference generator of claim 23, wherein the first control circuit comprises a third transistor of the second type including first and second terminals spaced apart with a channel therebetween and including a gate for controlling current in said channel, said first terminal being coupled to another voltage node and said gate is coupled to the input of the first control circuit, comprises a second resistor including a first terminal coupled to the second terminal of the third transistor of the second type and including a second terminal coupled to the output of the first control circuit, and comprises a third resistor including a first terminal coupled to the second terminal of the second resistor and including a second terminal coupled to the ground node, the second control circuit comprises a fourth transistor of the second type including first and second terminals spaced apart with a channel therebetween and including a gate for controlling current in said channel, said first terminal is coupled to said another voltage node and said gate is coupled to the input of the second control circuit, comprises a fourth resistor including a first terminal coupled to the second terminal of the fourth transistor of the second type and including a second terminal coupled to the output of the second control circuit and comprises a fifth resistor including a first terminal coupled to the second terminal of the fourth resistor and including a second terminal coupled to said ground node.

30. A bandgap reference generator comprising:

a first transistor of a first type including first and second terminals spaced apart with a channel therebetween and including a gate for controlling current in said channel, said first terminal being coupled to a voltage node;

a second transistor of the first type including first and second terminals spaced apart with a channel therebetween and including a gate for controlling current in said channel, said first terminal being coupled to the second terminal of the first transistor of the first type;

a first transistor of a second type including first and second terminals spaced apart with a channel therebetween and including a gate for controlling current in said channel, said first terminal being coupled to the second terminal of the second transistor of the first type;

a second transistor of the second type including first and second terminals spaced apart with a channel therebetween and including a gate for controlling current in said channel, said first terminal being coupled to the second terminal of the first transistor of the second type;

a first bipolar junction transistor including an emitter coupled to the second terminal of the second transistor of the second type, including a collector coupled to a ground node, and including a base coupled to said collector;

a third transistor of the first type including first and second terminals spaced apart with a channel therebetween and including a gate for controlling current in said channel, said first terminal being coupled to said voltage node, said gate being coupled to the gate of the first transistor of the first type;

a fourth transistor of the first type including first and second terminals spaced apart with a channel therebetween and including a gate for controlling current in said channel, said first terminal being coupled to the second terminal of the third transistor of the first type, said gate being coupled to the gate of the second transistor of the first type;

a third transistor of the second type including first and second terminals spaced apart with a channel therebetween and including a gate for controlling current in said channel, said first terminal being coupled to the second terminal of the fourth transistor of the first type, said gate being coupled to the gate of the first transistor of the second type;

a fourth transistor of the second type including first and second terminals spaced apart with a channel therebetween and including a gate for controlling current in said channel, said first terminal being coupled to the second terminal of the third transistor of the second type, said gate being coupled to the gate of the second transistor of the second type;

a first resistor including first and second terminals, said first terminal being coupled to the second terminal of the fourth transistor of the second type;

a second bipolar junction transistor including an emitter coupled to the second terminal of the first resistor, including a collector coupled to the ground node, and including a base coupled to said collector;

a first control circuit including a first input coupled to the first terminal of the first transistor of the second type, including a first output coupled to the gate of the first transistor of the second type, and including a second output coupled to the gate of the second transistor of the second type; and a second control circuit including a first input coupled to the second terminal of the fourth transistor of the first type, including a first output coupled to the gate of the third transistor of the first type, and including a second output coupled to the gate of the fourth transistor of the first type.

31. The bandgap reference generator of claim 30 wherein the first control circuit comprises a fifth transistor of the second type including first and second terminals spaced apart with a channel therebetween and including a gate for controlling current in said channel, said first terminal being coupled to the voltage node, said gate being coupled to the first input of the first control circuit, comprises a second resistor including a first terminal coupled to the second terminal of the fifth transistor of the second type and including a second terminal coupled to the first output of the first control circuit, comprises a third resistor including a first terminal coupled to the second terminal of the second resistor and including a second terminal coupled to the second output of the first control circuit, and comprises a fourth resistor including a first terminal coupled to the second terminal of the third resistor and including a second terminal coupled to the ground node, wherein the second control circuit comprises a sixth transistor of the second type including first and second terminals spaced apart with a channel therebetween and including a gate for controlling current in said channel, said first terminal being coupled to the voltage node, said gate being coupled to the first input of the second control circuit, comprises a fifth resistor including a first terminal coupled to the second terminal of the sixth transistor of the second type and including a second terminal coupled to the first output of the second control circuit, comprises a sixth resistor including a first terminal coupled to the second terminal of the second fifth and including a second terminal coupled to the second output of the second control circuit, and comprises a seventh resistor including a first terminal coupled to the second terminal of the sixth resistor and including a second terminal coupled to the ground node.

32. The bandgap reference generator of claim 30 further comprising a switch coupled between the emitter and the collector of the second bipolar junction transistor to selectively short said emitter to said collector.

33. The bandgap reference generator of claim 30 wherein the first control circuit comprises a fifth transistor of the second type including first and second terminals spaced apart with a channel therebetween and including a gate for controlling current in said channel, said first terminal being coupled to the voltage node, said gate being coupled to the first input of the first control circuit, comprises a second resistor including a first terminal coupled to the second terminal of the fifth transistor of the second type and including a second terminal coupled to the first output of the first control circuit, comprises a third resistor including a first terminal coupled to the second terminal of the second resistor and including a second terminal coupled to the second output of the first control circuit, comprises a fourth resistor including a first terminal coupled to the second terminal of the third resistor and including a second terminal, and comprises a sixth transistor of the second type including first and second terminals spaced apart with a channel therebetween and including a gate for controlling current in said channel, said second terminal being coupled to the ground node, said first terminal being coupled to the second terminal of the fourth resistor, and said gate being coupled to an enable signal node, wherein the second control circuit comprises a seventh transistor of the second type including first and second terminals spaced apart with a channel therebetween and including a gate for controlling current in said channel, said first terminal being coupled to the voltage node, said gate being coupled to the first input of the second control circuit, comprises a fifth resistor including a first terminal coupled to the second terminal of the sixth transistor of the second type and including a second terminal coupled to the first output of the second control circuit, comprises a sixth resistor including a first terminal coupled to the second terminal of the second fifth and including a second terminal coupled to the second output of the second control circuit, comprises a seventh resistor including a first terminal coupled to the second terminal of the sixth resistor and including a second terminal, comprises an eighth transistor of the second type including first and second terminals spaced apart with a channel therebetween and including a gate for controlling current in said channel, said second terminal being coupled to the ground node, said first terminal being coupled to the second terminal of the seventh resistor, and said gate being coupled to the enable signal node.

34. The bandgap reference generator of claim 33 wherein the second control circuit further comprises a fifth transistor of the first type including first and second terminals spaced apart with a channel therebetween and including a gate for controlling current in said channel, said first terminal being coupled to the voltage node, said second terminal being coupled to the first output of the second control circuit, and said gate being coupled to said enable signal node.

35. The bandgap reference generator of claim 33 wherein the enable signal node is a power down signal node.

36. The bandgap reference generator of claim 33 wherein the first and second control circuits include a power down circuit.

37. The bandgap reference generator of claim 36 further comprising a biasing circuit for biasing the first and second control circuits.

38. The bandgap reference generator of claim 33 wherein the first control circuit comprises a ninth transistor of the second type including the first and second terminals spaced apart with a channel therebetween and including a gate for controlling current in said channel, said first terminal being coupled to the first terminal of the sixth transistor of the second type, said second terminal being coupled to the second terminal of the sixth transistor of the second type, the second control circuit further comprises a tenth transistor of the second type including first and second terminals spaced apart with a channel therebetween and including a gate for controlling current in said channel, said first terminal being coupled to the first terminal of the eighth transistor of the second type, said second terminal being coupled to the second terminal of said eighth transistor of the second type, the bandgap reference generator further comprising a biasing circuit for biasing the ninth and tenth transistors of the second type.

39. The bandgap reference generator of claim 38 wherein the biasing circuit comprises a fifth transistor of the first type including first and second terminals spaced apart with a channel therebetween and including a gate for controlling current in said channel, said first terminal being coupled to the voltage node, said gate being coupled to the gate of the first transistor of the first type, comprising a sixth transistor of the first type including first and second terminals spaced apart with a channel therebetween and including a gate for controlling current in said channel, said first terminal being coupled to the second terminal of the fifth transistor of the first type, said gate being coupled to the gate of the second transistor of the first type, and comprises an eleventh transistor of the second type including first and second terminals spaced apart with a channel therebetween and including a gate for controlling current in said channel, said first terminal being coupled to said gate and to said second terminal of the sixth transistor of the first type, said second terminal being coupled to the ground node, said gate being coupled to the gates of the ninth and tenth transistors of the second type.

40. The bandgap reference generator of claim 39 further comprising a startup circuit to provide a startup current.

41. The bandgap reference generator of claim 40 wherein the startup circuit comprises:

a seventh transistor of the first type including first and second terminals spaced apart with a channel therebetween and including a gate for controlling current in said channel, said first terminal being coupled to the voltage node, said gate being coupled to the ground node, an eighth transistor of the first type including first and second terminals spaced apart with a channel therebetween and including a gate for controlling current in said channel, said first terminal being coupled to the second terminal of the seventh transistor of the first type, said gate being coupled to the ground node, an twelfth transistor of the second type including first and second terminals spaced apart with a channel therebetween and including a gate for controlling current in said channel, said second terminal being coupled to the ground node, said first terminal being coupled to the second terminal of the eighth transistor of the first type, said gate being coupled to said first terminal, a thirteenth transistor of the second type including first and second terminals spaced apart with a channel therebetween and including a gate for controlling current in said channel, said first terminal being coupled to the first terminal of the twelfth transistor of the second type, said second terminal being coupled to the second terminal of the twelfth transistor of the second type, said gate being coupled to the first terminal of the eleventh transistor of the second type, and a fourteenth transistor of the second type including first and second terminals spaced apart with a channel therebetween and including a gate for controlling current in said channel, said first terminal being coupled to the gate of the first transistor of the first type, said second terminal being coupled to said ground node, said gate being coupled to the first terminal of the twelfth transistor of the second type.

42. The bandgap reference generator of claim 33 further comprising a switch coupled between the emitter and the collector of the second bipolar junction transistor to selectively short said emitter to said collector.

43. The bandgap reference generator of claim 42 wherein the switch is dynamically opened and closed to sample currents in the fourth MOS transistor of the second type.

44. The bandgap reference generator of claim 33 wherein the first control circuit comprises a fifth transistor of the second type including first and second terminals spaced apart with a channel therebetween and including a gate for controlling current in said channel, said first terminal being coupled to the voltage node, said gate being coupled to the first input of the first control circuit, comprises a second resistor including a first terminal coupled to the second terminal of the fifth transistor of the second type and including a second terminal coupled to the first output of the first control circuit, comprises a third resistor including a first terminal coupled to the second terminal of the second resistor and including a second terminal coupled to the second output of the first control circuit, comprises a fourth resistor including a first terminal coupled to the second terminal of the third resistor and including a second terminal, and comprises a first current source including a first terminal coupled to the second terminal of the fourth resistor and including a second terminal coupled to the ground node, wherein the second control circuit comprises a sixth transistor of the second type including first and second terminals spaced apart with a channel therebetween and including a gate for controlling current in said channel, said first terminal being coupled to the voltage node, said gate being coupled to the first input of the second control circuit, comprises a fifth resistor including a first terminal coupled to the second terminal of the sixth transistor of the second type and including a second terminal coupled to the first output of the second control circuit, comprises a sixth resistor including a first terminal coupled to the second terminal of the second fifth and including a second terminal coupled to the second output of the second control circuit, comprises a seventh resistor including a first terminal coupled to the second terminal of the sixth resistor and including a second terminal, and comprises a second current source including a first terminal coupled to the second terminal of the seventh resistor and including a second terminal coupled to the ground node.

45. The bandgap reference generator of claim 44 further comprising an eighth resistor including a first terminal coupled to the emitter of the second bipolar junction transistor and including a second terminal coupled to the collector of the second bipolar junction transistor.

46. The bandgap reference generator of claim 45 further comprising an output circuit.

47. The bandgap reference generator of claim 46 wherein the output circuit comprises:

a fifth transistor of the first type including first and second terminals spaced apart with a channel therebetween and including a gate for controlling current in said channel, said first terminal being coupled to the voltage node, said gate being coupled to the gate of the first transistor of the first type, a sixth transistor of the first type including first and second terminals spaced apart with a channel therebetween and including a gate for controlling current in said channel, said first terminal being coupled to the second terminal of the fifth transistor of the first type, said gate being coupled to the gate of the second transistor of the first type, and a ninth resistor including a first terminal coupled to the second terminal of the sixth transistor of the first type to form an output node and including a second terminal coupled to the ground node.

48. A bandgap reference generator comprising:

a current mirror circuit having two current paths, a first current path passing through a first MOS transistor and a first bipolar junction transistor; a second current path passing through a second MOS transistor, a trimmable resistor, and a second bipolar junction transistor, wherein a current through said resistor is indicative of a difference in voltages across the first and second bipolar junction transistors; and a high impedance control circuit coupled between a drain and gate of said second MOS transistor.

49. A bandgap reference generator comprising:

a current mirror circuit having two current paths, a first current path passing through a first MOS transistor and a first bipolar junction transistor; a second current path passing through a second MOS transistor, a trimmable resistor, and a second bipolar junction transistor, wherein a current through said resistor is indicative of a difference in voltages across the first and second bipolar junction transistors; and a high impedance voltage shifter coupled between a drain and gate of said second MOS transistor.

* * * * *